US011678731B1

(12) United States Patent
Howard

(10) Patent No.: US 11,678,731 B1
(45) Date of Patent: Jun. 20, 2023

(54) RAZOR CLEANING DEVICE FOR SINK, BATH, AND SHOWER

(71) Applicant: Preston Leon Howard, Hollywood, SC (US)

(72) Inventor: Preston Leon Howard, Hollywood, SC (US)

( * ) Notice: Subject to any disclaimer, the term of this patent is extended or adjusted under 35 U.S.C. 154(b) by 234 days.

(21) Appl. No.: 17/234,499

(22) Filed: Apr. 19, 2021

Related U.S. Application Data

(60) Provisional application No. 63/012,312, filed on Apr. 20, 2020.

(51) Int. Cl.
*A45D 27/46* (2006.01)
*B08B 3/02* (2006.01)

(52) U.S. Cl.
CPC ..... *A45D 27/46* (2013.01); *B08B 3/02* (2013.01); *B08B 2203/0211* (2013.01)

(58) Field of Classification Search
CPC .... A45D 27/46; B08B 3/02; B08B 2203/0211
See application file for complete search history.

(56) References Cited

U.S. PATENT DOCUMENTS 3,396,462 A 8/1968 Dufresne
4,027,387 A * 6/1977 Kellis ..... A45D 27/46 134/182
4,480,387 A 11/1984 d'Alayer de Costemore d'Are
4,838,949 A 6/1989 Dugrot
4,890,348 A * 1/1990 Racioppi ..... A46B 15/0097 15/160
4,941,492 A * 7/1990 Morgan ..... A45D 27/46 134/182
5,365,958 A 11/1994 Stuhlmacher, II
6,009,622 A 1/2000 Liedblad
6,886,211 B2 5/2005 Severino
7,043,842 B1 * 5/2006 Taylor ..... B26B 21/44 30/41.5
7,143,517 B2 12/2006 Kappes et al.
7,316,236 B2 1/2008 Hoser
9,439,494 B2 9/2016 Brady, Jr.
9,868,220 B2 1/2018 Moffat
9,914,154 B2 3/2018 Rabie
10,631,613 B1 * 4/2020 Totonelly ..... A45D 27/46
11,266,218 B1 * 3/2022 Totonelly ..... B08B 3/02
2002/0145058 A1 10/2002 Tziviskos
(Continued)

*Primary Examiner* — Benjamin L Osterhout
(74) *Attorney, Agent, or Firm* — The Patent Professor, P.A.; John Rizvi

(57) ABSTRACT

A razor cleaning device for use in a sink, bathtub, and/or shower allows a user to quickly and efficiently dislodge and displace hair cutting debris which accumulates between the blades of a razor while shaving. The razor cleaning device has a base assembly which provides a flow of water therethrough and into a spray head assembly. The spray head assembly is positionable along the base assembly into and out of an operative configuration, and has a plurality of spray nozzles arranged in a spray nozzle array thereon. A water supply line is connected between an inlet port of the base assembly and a water supply. The spray head assembly also includes a valve operable by the user to selectively permit water to flow to each of the plurality of spray nozzles, wherein the plurality of spray nozzles discharge jets of water in a predetermined spray pattern.

20 Claims, 8 Drawing Sheets

(56) References Cited

U.S. PATENT DOCUMENTS

| | | | | |
|---|---|---|---|---|
| 2006/0283487 | A1 | 12/2006 | Grabowski | |
| 2008/0006311 | A1 | 1/2008 | Brown et al. | |
| 2008/0030671 | A1* | 2/2008 | You | G02F 1/13454 349/187 |
| 2014/0208601 | A1 | 7/2014 | Battin et al. | |
| 2017/0197234 | A1* | 7/2017 | Rabie | A45D 27/46 |
| 2017/0245616 | A1 | 8/2017 | Lakios et al. | |
| 2018/0192757 | A1 | 7/2018 | Lam | |
| 2019/0307222 | A1* | 10/2019 | Hug | A45D 27/46 |
| 2021/0235840 | A1* | 8/2021 | Kattan | B08B 3/006 |
| 2021/0299710 | A1* | 9/2021 | Hayden | B08B 3/041 |

* cited by examiner

RAZOR CLEANING DEVICE FOR SINK, BATH, AND SHOWER

CROSS-REFERENCE TO RELATED APPLICATIONS

This application claims the benefit of U.S. Provisional Patent Application Ser. No. 63/012,312 filed on Apr. 20, 2020, which is incorporated by reference herein in its entirety.

Field of the Invention

The present invention relates generally to a razor cleaning device for use in a sink, a bathtub, and/or a shower, and more particularly, to a razor cleaning device which directs jets of water in a predetermined spray pattern onto the head of a razor for removing hair cutting debris from between one or more cutting blades of the razor while one is shaving, whether at a sink, or in a bathtub or a shower.

BACKGROUND OF THE INVENTION

It is common for individuals to engage in the hygienic practice of shaving whether it involves a man shaving his beard or mustache, or a woman shaving her legs. There are various shaving devices available on the market today including electric razors or shavers having reciprocating or oscillating blades, and ultrasonic razors having vibration induced blades to assist in shaving. A more common razor used by many includes disposable or safety razors, or razors having disposable cartridges. Such razors generally include a handle and a razor head or cartridge attachment to the end of the handle. Many companies market the advantage of using disposable razors that have a plurality of cutting blades for providing a closer, smooth shave. Most disposable razors generally include anywhere between one and five cutting blades provided on the head of the razor, or cartridges that include a plurality of blades where the blades are arranged in a step configuration forming small passages between each blade to allow hair shaving debris to exit through the small passages. Shaving gels, foams, or creams are often used to condition the hair and skin of the shaver and reduce frictional contact of the blades on the user's skin to provide a comfortable shave.

Shaving often occurs throughout various places of the home, either near a sink, in the bathtub, or in the shower. For example, in considering the ways that men and woman shave, some men shave in the shower, while others stand in front of the sink to view the shaving progress in a mirror. Woman often shave their legs in the shower with their feet on the shower floor, resting on the perimeter of the bathtub, or on a seat provided within the shower. During the course of shaving, loose hair often mingles with the shaving cream to form a residue lodged between the small passages of the razor blades. The build-up of residue typically occurs after just a few shaving strokes. To retain the adequate function of the razor, users must constantly clean the razor blades while shaving. Various methods are employed by users in an attempt to clean the razor blades, for example, users often place the head of the razor under the water faucet, or under the shower head, to direct the flow of water over the razor blades to force out hair shaving residue. In doing so, users often hold the head of the razor under the faucet and shake the razor vigorously numerous times in an effort to force the cut hair and shaving cream out from between the blades. In conjunction with rinsing the razor, users also often rap the head of the razor on the bottom or edge of the sink or shower to provide a jolted force to attempt to further dislodge debris remaining between the razor blades. Still other users will submerge the head of the razor into a sink of water, or receptacle full of cleaning solution, and shake or swish the head of the razor back and forth numerous times for the liquid to pass between the blades to flush out the hair debris. Such cleaning actions are performed repeatedly throughout the course of shaving, it is a particularly slow process and often does a poor job at removing hair cutting debris from between the razor blades. Further, running a faucet during the entire shaving process results in considerable water usage for each shave. On many occasions, the remaining hair residue is tightly jammed between the razor blades requiring a stronger force of water, or further rapping of the razor head on a surface. Many individuals do not take the time necessary to completely remove the cut hair from the blades, and thus, any residue remaining between the blades hardens over time as it dries making more difficult if not impossible to clean between the blades. As a result, many users simply replace existing razor blade cartridges or disposable razors with new ones much more often than necessary, leading to increase waste and costs.

Conventional razor cleaning devices or systems are provided to assist individuals in removing hair cutting debris from between razor blades during or after use. For example, some devices generally include a funnel or scoop attached directly to the spout of a faucet, or to the head of the razor, for directing water over the blades of the razor to dislodge any shaving debris lodged between the razor blades. More sophisticated razor cleaning devices generally include a container having a reservoir for holding a cleaning solution therein, and an electricity or battery operated transducer, pump, or spray jet device, for circulating or spraying cleaning solution past the head of the razor when the head of razor is disposed within the cleaning solution of the reservoir. Many razor cleaning devices have added features such as timers for setting time and length of cleaning, status indicators as to when to change the cleaning solution, include radio and/or clock features, and ultraviolet radiation sources to clean the surface of the blades for sanitary, or disinfectant purposes. Although such prior art devices provide some assistance in cleaning razor blades of disposable or safety razors, and/or blades provided on disposable cartridges, such devices are either, cumbersome to use while shaving, or are used for cleaning razor blades after the user has finished shaving. The prior art razor cleaning devices, such as scoops, or reservoir filled cleaning solutions, do not allow users to effectively use such devices, or clean the razor blades of a razor, effectively while in the process of shaving or showering.

There is often a desire, whether to save time, or simply for added convenience, to shave in a bathtub or while taking a shower. The conventional shower head provides a water spray for washing the body and is also used to quickly rinses any shaving cream, soap, or hair-shaving debris remaining on the body. When shaving in a bathtub or a shower, users typically hold the head of a razor in close proximity to the faucet or the spray apertures of the shower head in hopes of projecting water directly onto the blades of a razor to flush out any hair-shaving debris from between the blades. On many occasions, users orient the head of the razor in different positions, while under the faucet or shower head, to align the water spray between the blades to remove hair shaving debris, a process which is repeated over and over again while shaving. Users often adjust rotating shower heads to increase water pressure or flow in an effort to increase the force of water to adequately clean the razor blades. As such, neither conventional faucets nor shower heads provide a prescribed means of effectively cleaning razor blades of a razor leaving users to resort to other cumbersome methods of cleaning the razor blades. As a result, many individuals simply do not take the time needed to adequately clean the razor blades.

Accordingly, there is an established need for solving the aforementioned problems by providing a razor cleaning device which may be utilized to quickly and easily direct and jet water onto the head of a razor for removing hair cutting debris from between one or more cutting blades of the razor while one is shaving, whether at a sink, or in a bathtub or a shower.

SUMMARY OF THE INVENTION

The present invention is directed to a razor cleaning device which directs jets of water in a predetermined spray pattern onto the head of a razor for removing hair cutting debris from between one or more cutting blades of the razor while one is shaving, whether at a sink, or in a bathtub or a shower.

A first embodiment of the present invention provides a razor cleaning device for use in a sink, bathtub, or shower to allow a user to quickly and efficiently dislodge and displace hair cutting debris which accumulates between one or more blades in a head of a razor while shaving, the razor cleaning device comprises: a base assembly having a water inlet, a base water delivery conduit, and a water outlet port cooperatively constructed in fluid communication with one another to permit a flow of water into and through the base assembly; at least one mounting member to facilitate mounting the base assembly to a portion of the sink, bathtub, or shower in an operative orientation; a spray head assembly having an enclosed surface on one side and a spray surface oppositely disposed on another side; the spray head assembly positionable into and out of an operative configuration; the spray surface having a plurality of spray nozzles disposed thereon forming a spray nozzle array; the spray head assembly further comprising a water delivery conduit disposed therethrough having a water inlet port at one end disposed in fluid communication with the water outlet port of said base assembly; the plurality of spray nozzles disposed in fluid communication with the water delivery conduit opposite the water inlet port; the spray head assembly further comprising a valve operatively disposed in communication with the water delivery conduit between the water inlet port and the plurality of spray nozzles, and a valve control switch operable by the user into and out of an open position, wherein the open position permits water to flow through the water delivery conduit to the plurality of spray nozzles; and, the plurality of spray nozzles disposed in the spray nozzle array discharge jets of water in a predetermined spray pattern while the valve control switch is disposed in the open position, wherein the jets of water discharged through the plurality of spray nozzles in the predetermined spray pattern are sufficient to dislodge hair cutting debris which accumulates between one or more blades in the head of the razor, and to discharge the hair cutting debris therefrom.

In a second aspect, the spray head track may comprise an open end and an oppositely disposed closed end, said closed end serving as a stop to prevent further rearward movement of the spray head assembly along the spray head track while disposed in a closed configuration.

In another aspect, the spray head assembly can include a base interconnect wherein at least a portion of the base interconnect is disposable within and along a portion of the spray head track of the base assembly.

In still another aspect, a base interconnect and the spray head track may comprise complimentary geometric configurations relative to one another.

In yet one further aspect, a pivot assembly can be provided in an interconnecting disposition between the base assembly and the spray head assembly.

In still one further aspect, the spray head assembly may be movable relative to the base assembly.

In another aspect, the spray head assembly may be pivotably rotational relative to the base assembly about a pivot assembly.

In yet another aspect, the spray head assembly can include a spray head which is movable about a spray head interconnect relative to a pivot assembly.

In another aspect, the spray head assembly may comprise a spray head which is rotational about a spray head interconnect relative to a pivot assembly.

In yet another embodiment, a base support may be mounted in, on or around a sink, bathtub or shower, wherein the base support is dimensioned and configured such that at least a base member is removably positionable into and out an operative supported disposition within the base support.

These and other objects, features, and advantages of the present invention will become more readily apparent from the attached drawings and the detailed description of the preferred embodiments, which follow.

BRIEF DESCRIPTION OF THE DRAWINGS

The preferred embodiments of the invention will hereinafter be described in conjunction with the appended drawings provided to illustrate and not to limit the invention, where like designations denote like elements, and in which.

DETAILED DESCRIPTION

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to make or use the embodiments of the disclosure and are not intended to limit the scope of the disclosure, which is defined by the claims. For purposes of description herein, the terms "upper", "lower", "left", "rear", "right", "front", "vertical", "horizontal", and derivatives thereof shall relate to the invention as oriented in FIGS. 1 and 6, respectively. Furthermore, there is no intention to be bound by any expressed or implied theory presented in the preceding technical field, background, brief summary or the following detailed description. It is also to be understood that the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

As shown throughout the FIGS., the present invention is directed to a razor cleaning device for use by a person who is shaving while at a sink, or in a bathtub or a shower. As further shown throughout the FIGS., and as described in greater detail hereinafter, the razor cleaning device in accordance with the present invention includes a spray head assembly having a spray nozzle array comprised of one or more spray nozzles which are dimensioned and positioned to discharge jets of water in a predetermined spray pattern to quickly and efficiently dislodge and discharge hair cutting debris from between one or more blades in a head of a razor blade.

Figure 1:
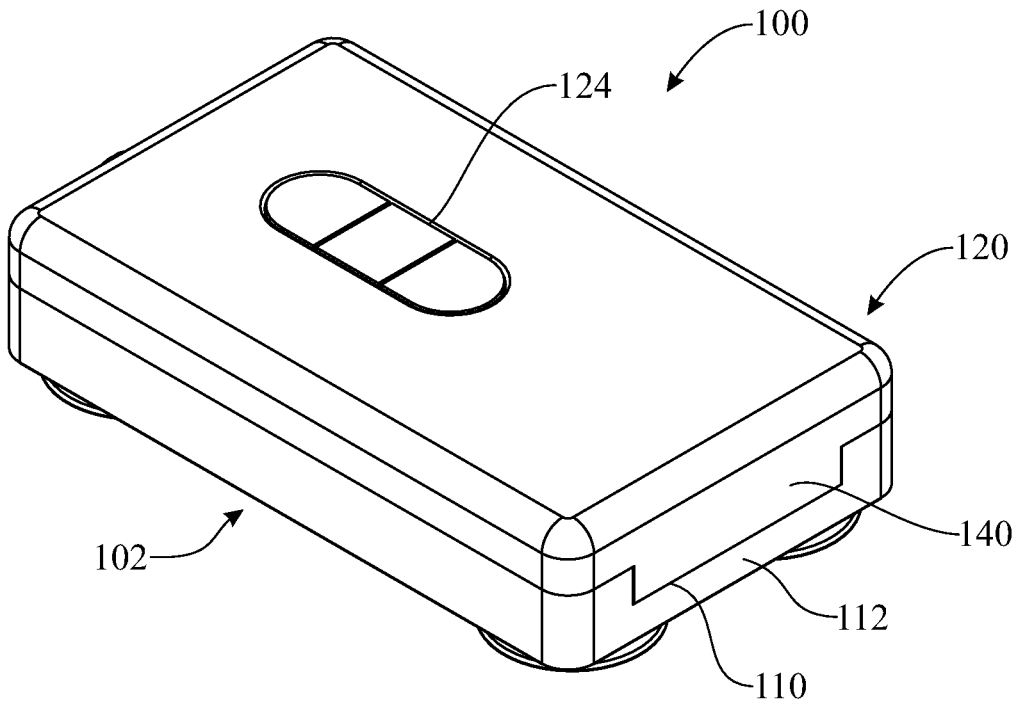
FIG. 1 is a top perspective view of one illustrative embodiment of a razor cleaning device disposed in a closed configuration, in accordance with the present invention.

Looking first to FIG. 1, there is shown one illustrative embodiment of a razor cleaning device for use at a sink, or in a bathtub or a shower, which is generally shown as 100 in FIGS. 1 through 5. As may be seen from the embodiment of FIG. 1, the razor cleaning device 100 includes a base assembly 102 having a spray head assembly 120 operably interconnected thereto. In at least one embodiment, a base assembly 102 of a razor cleaning device 100 in accordance with the present invention includes a spray head track 110. As further shown in the embodiment of FIG. 1, the spray head assembly 120 includes a base interconnect 140 which is disposable on and along the spray head track 110 of the base assembly 102.

Figure 2:
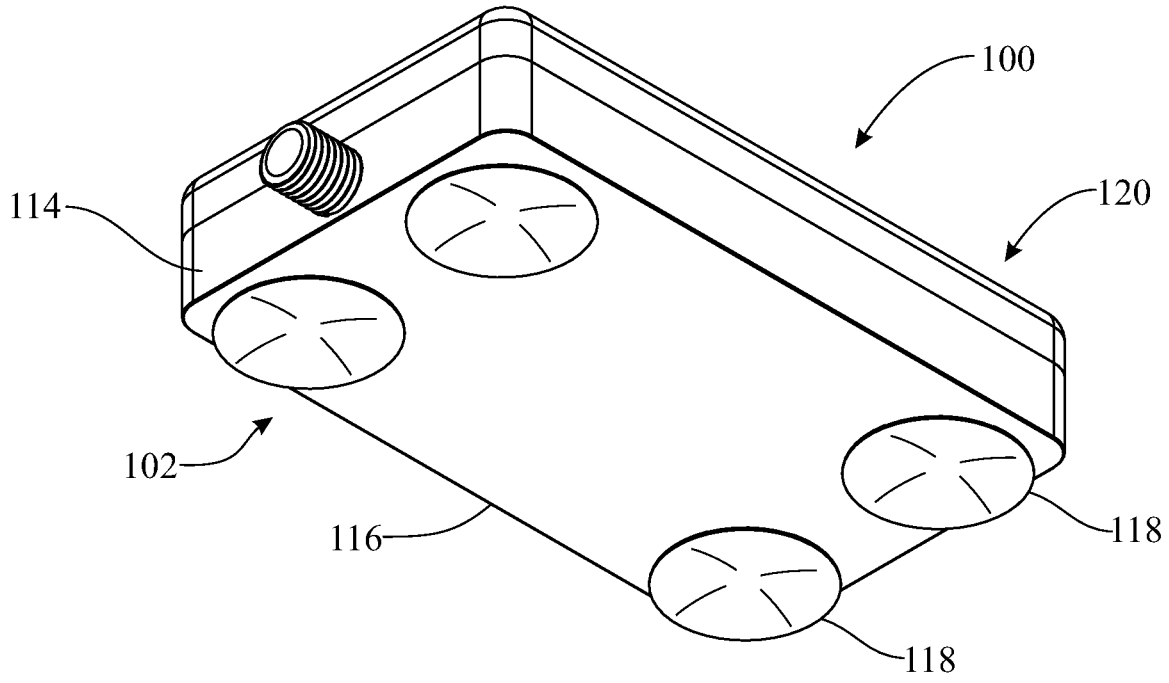
FIG. 2 is a bottom perspective view of the embodiment of the razor cleaning device of FIG. 1 disposed in a closed configuration, in accordance with the present invention.

In at least one embodiment, a spray head track 110 comprises an open end 112, as shown in FIG. 1, and an oppositely disposed closed end 114 as shown in FIG. 2. The closed end 114 of the spray head track serves as a stop, abutting a portion of the base interconnect 140 of the spray head assembly 120 while the razor cleaning device 100 is disposed in a closed configuration, as shown in FIGS. 1 and 2. More in particular, the closed end 114 of the spray head track 110 prevents movement of the spray head assembly 120 in a rearward direction relative to the base assembly 102 beyond the closed configuration as shown in FIGS. 1 and 2.

With continued reference to the embodiment of the razor cleaning device 100 as shown in FIG. 2, the base assembly 102 includes a mounting surface 116 disposed along the underside thereof. Further, one or more mounting members 118 are provided to mount a base assembly 102 of the present razor cleaning device 100 to a portion of a sink, bathtub, and shower, depending upon the location in which a user is shaving. Looking again to FIG. 2, in at least one embodiment, a mounting member 118 comprises a suction cup such as are commonly utilized to secure toiletry related items in, on, and/or around a sink, a bathtub, and/or a shower. As further shown in FIG. 2, in at least one embodiment, a plurality of mounting members 118 are provided to removably yet securely mount the base assembly 102 of the razor cleaning device 100 in, on, and/or around a sink, a bathtub, and/or a shower.

As will be appreciated, while shown throughout the FIGS. as a suction cup, a mounting member 118 in accordance with the present invention may comprise any of a number of mechanical fasteners to removably or permanently mount a base assembly 102 in, on, and/or around a sink, a bathtub, or shower, including but not limited to nails, screws, hangers, adhesives, etc., just to name a few.

Figure 3:
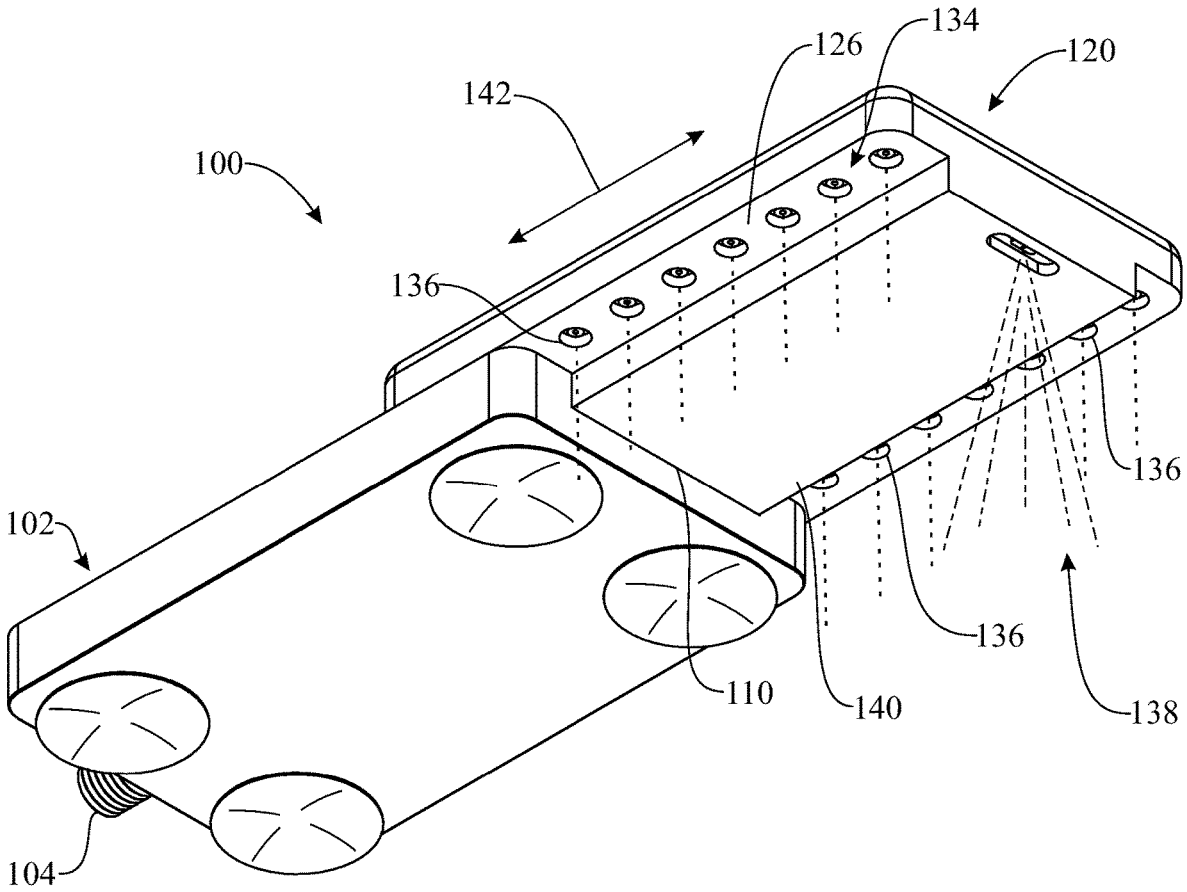
FIG. 3 is a bottom perspective view of the embodiment of the razor cleaning device of FIG. 1 disposed in open operative configuration, showing a nozzle array having a plurality of nozzles discharging jets of water in a predetermined spray pattern, in accordance with the present invention.

Looking next to FIG. 3, a bottom perspective view of one embodiment of a razor cleaning device 100 disposed in an open operative configuration in accordance with the present invention is presented. The razor cleaning device 100 comprises a base assembly 102 including a water inlet 104 disposed in a fluid communicating relation to the base assembly 102, as explained in greater detail below. Also as before, the razor cleaning device 100 comprises a spray head assembly 120 which is shown in FIG. 3 disposed in an open operative configuration. More particular, the spray head assembly 120 is extended outwardly from the base assembly 102 along the spray head track 110. With continued reference to the embodiment of FIG. 3, the spray head assembly 120 comprises a base interconnect 140 which is movable forward and rearward in and along the spray head track 110 of the base assembly 102, as shown by the directional arrow 142 in FIG. 3.

As shown in the FIGS., the spray head track 110 and the base interconnect 140 comprises complementary geometric configurations, in particular, generally rectangular configurations. As will be appreciated, however, the spray head track 110 and the base interconnect 140 may comprise any of a number of complementary geometric configurations. As one example, the sidewalls of the spray head track 110 may comprise convex configurations while the sidewalls of the base interconnect 140 comprise complementary concave configurations, or vice versa, so as to securely yet movably retain the base interconnect 140 in and along the spray head track 110. As another example, the base interconnect 140 may be securely yet movably retained in and along the spray head track 110 by way of corresponding and complementary slot and channel type configurations.

With continued reference to FIG. 3, in accordance with at least one embodiment of the present invention a spray head assembly 120 comprises a spray surface 126 along a downward facing surface thereof. Furthermore, the spray head assembly 120 includes a spray nozzle array 134 disposed along at least a portion of the spray surface 126. As shown in the embodiment of FIG. 3, the spray nozzle array 134 comprises a plurality of spray nozzles 136. More in particular, and as further shown in the embodiment of FIG. 3, a plurality of spray nozzles 136 of the spray nozzle array 134 are arranged to discharge jets of water therethrough in a predetermined spray pattern 138. The predetermined spray pattern 138 is at least partially defined by the plurality of spray nozzles 136 positioned in the spray nozzle array 134 of the spray head assembly 120. The predetermined spray pattern 138 is further defined by such factors as the dimensions and configuration of the discharge port or ports through each spray nozzle 136, as well as the volume and pressure of the jets of water discharged therethrough.

It is understood that the size of each spray nozzle 136 is selected and designed to permit water to jet out at a predetermined force or pressure, and may comprise any number of channels or apertures that are oriented on or along the spray surface 126 of the spray head assembly 120 as needed to produce a predetermined spray pattern 138 therefrom. In one exemplary embodiment, the spray nozzles 136 are disposed in a peripheral orientation along the spray surface 126, such as is shown by way of example in the illustrative embodiment of FIG. 3. However, as is further understood, a plurality of spray nozzles 136 may be disposed in any variation, layout, or orientation on or along the spray surface 126 of the spray head assembly 120. Each spray nozzle 136 may comprise any of, channels or apertures that are formed through the spray surface 126, or include rubber, plastic, or metal nozzle extensions or ports extending from, or associated with, corresponding spray holes. It will be understood that in another embodiment, the spray head assembly 120 may include a mechanical or electrical system to allow users to adjust both the pattern or delivery pressure of water ejecting from the spray nozzles 136. For example, a rotating disc or valve system can be incorporated to provide a spray pattern, a trickle pattern, a power spray pattern, or any combination thereof.

Figure 4:
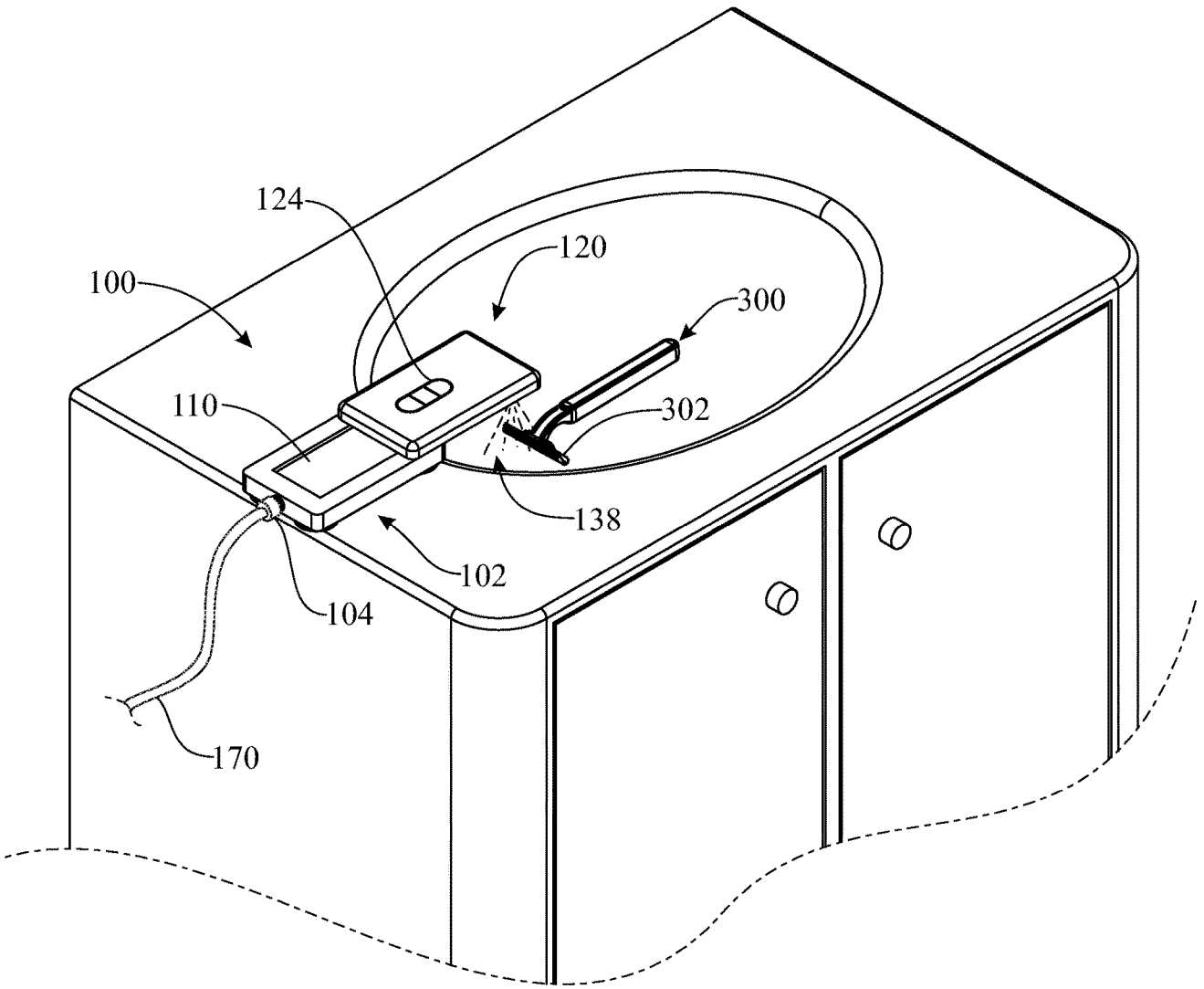
FIG. 4 is a top perspective view of the embodiment of the razor cleaning device of FIG. 1 operatively mounted adjacent a sink and showing a spray head assembly discharging jets of water in a predetermined spray pattern to remove hair cutting debris from between one or more blades in a head of a razor positioned thereunder, in accordance with the present invention.

Looking next to FIG. 4, a top perspective view of a razor cleaning device 100 operatively mounted adjacent a sink in accordance with the present invention is presented. More in particular, FIG. 4 shows a spray head assembly 120 disposed in an open operative configuration discharging jets of water in a predetermined spray pattern 138 to remove hair cutting debris from between one or more blades in the head 302 of the razor 300 positioned thereunder. As may also be seen from FIG. 4, in at least one embodiment, a base assembly 102 includes a water inlet 104 disposed in fluid communication therewith. A water supply line 170 is connected to the water inlet 104 so as to supply a flow of water into and through the base assembly 102, into the spray head assembly 120, and out through one or more spray nozzles 136 of a spray head assembly 120 in a predetermined flow pattern 138. As may also be seen from the illustrative embodiment of FIG. 4, the spray head assembly 120 is moveable along the spray head track 110 of the base assembly 102 into the open operative configuration shown therein.

Importantly, in at least one embodiment of a razor cleaning device 100 in accordance with the present invention, such as is shown by way of example in FIG. 4, the predetermined spray pattern 138 of the jets of water discharged through the spray nozzles 136 (not shown) of the spray head assembly 120 is configured such that the jets of water quickly and efficiently dislodge hair cutting debris between one or more blades in the head 302 of the razor 300 operatively positioned under and into the predetermined spray pattern 138. Furthermore, the jets of water quickly and efficiently discharge the hair cutting debris out of the head 302 of the razor 300, into the sink, or a bathtub or shower, such that a user may continue with his or her hair shaving activity.

The water supply line 170 includes one end that is permanently or removably coupled to the water inlet port 104 of the base assembly 102, and another end that is coupled to a water supply source such as is readily available to supply a sink, bathtub, and/or shower. The water supply line 170 is designed to deliver water flow to the water inlet port 104 of the base assembly 102, and into and through the spray head assembly 120, and out through one or more spay nozzles 136. In another embodiment, the water supply line 170 is generally constructed from any of plastic, plated stainless steel, PVC flexible material, or stainless steel, or brass material. In another embodiment, the water supply line 170 may include an attachment device such as a clamp, twist-lock connector, bayonet connector, spring detent connector, or coupling, adapted for removable attachment to the water inlet port 104 of the base assembly 102. In still one further embodiment, the water supply line 170 comprises any well-known shower hose currently available on the market today. As will be appreciated, the water supply line 170 may comprise any color selected to match with the base assembly 102, and/or the spray head assembly 120, and/or the existing sink, bathtub, and/or shower.

Figure 5:
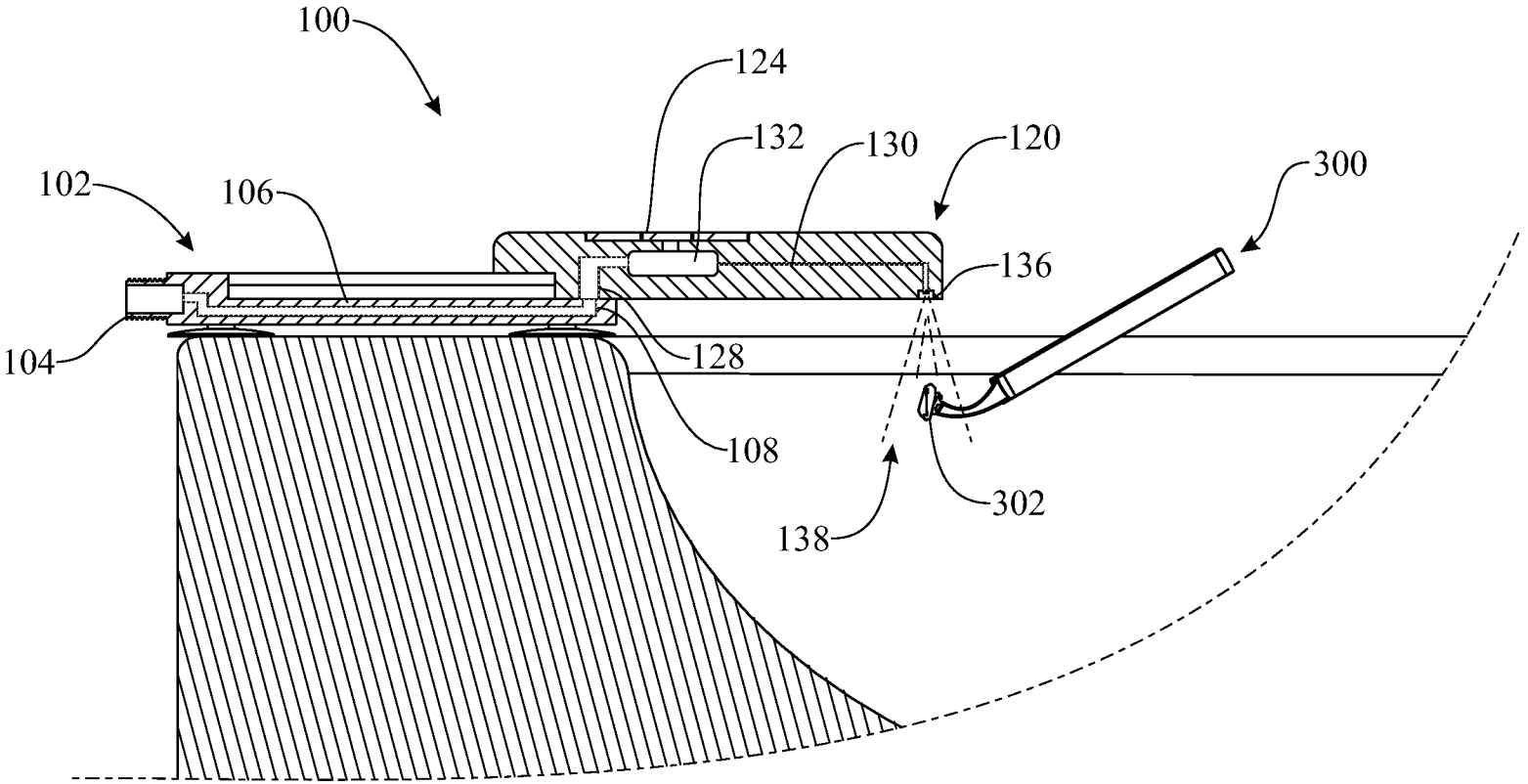
FIG. 5 is a partial cross-sectional view of the embodiment of the razor cleaning device of FIG. 1 operatively mounted adjacent a sink and showing a spray head assembly discharging jets of water in a predetermined spray pattern to remove hair cutting debris from between one or more blades in a head of a razor positioned thereunder, in accordance with the present invention.

FIG. 5 is a cross-sectional view of the razor cleaning device 100 of FIG. 1 illustrative of a flow of water therethrough. As before, a razor cleaning device 100 includes a base assembly 102 having a water inlet 104 disposed in fluid communication on a portion thereof. Also as before, a water supply line 170 is connected to the water inlet 104 so as to supply water to the razor cleaning device 100. The water inlet 104 is disposed in fluid communication with a base water delivery conduit 106, which terminates at a water outlet port 108 from the base assembly 102, as may be seen from the embodiment of FIG. 5.

With continued reference to FIG. 5, the razor cleaning device 100, once again, includes a spray head assembly 120. Similar to the base assembly 102, in at least one embodiment, the spray head assembly 120 includes a water delivery conduit 130 extending therethrough. As shown in FIG. 5, the water delivery conduit 130 includes a water inlet port 128 which is disposed in fluid communication with water outlet port 108 of the base assembly 102, while the spray head assembly 120 is disposed in an open operative configuration. More in particular, as further shown in FIG. 5, when the spray head assembly 120 is disposed in an open operative configuration, the water inlet port 128 is disposed in alignment with water outlet port 108 of the base assembly 102. As such, water can flow from a water supply 170 into the water inlet 104, into and through the base water delivery conduit 106, out through the water outlet port 108 of the base assembly 102, and into the water inlet port 128 of the spray head assembly 120.

FIG. 5 further shows a valve 132 disposed in-line in the water delivery conduit 130 of the spray head assembly 120. A valve control switch 124, as best shown in FIGS. 1 and 4, is operable by a user from a closed position to an open position, thereby opening the valve 132 and permitting water to flow through the water delivery conduit 130 of the spray head assembly 120, and out through one or more of a plurality of spray nozzles 136 thereof. With continued reference to FIG. 5, water is discharged from the spray nozzles 136 of the spray head assembly 120 in a predetermined spray pattern 138 onto the head 302 of the razor 300 positioned thereunder. Furthermore, the jets of water discharged through spray nozzles 136 in the predetermined spray pattern 138 dislodge hair cutting debris which accumulates between one or more blades in the head 302 of the razor 300 and, further, discharge the hair cutting debris therefrom, as stated above.

Looking next to FIGS. 6 through 10 herein, another illustrative embodiment of a razor cleaning device 200 in accordance with the present invention is presented. Looking first to the illustrative embodiment of FIG. 6, a top perspective view of a razor cleaning device 200 disposed in a first operative configuration is shown. As with the embodiment of the razor cleaning device 100 of FIGS. 1 through 5, razor cleaning device 200 includes a base assembly 202 having a water inlet 204 disposed in fluid communication therewith. Also similar to the embodiment of the razor cleaning device 100, the razor cleaning device 200 comprises a spray head assembly 220 operatively interconnected to a base assembly 202.

Figure 6:
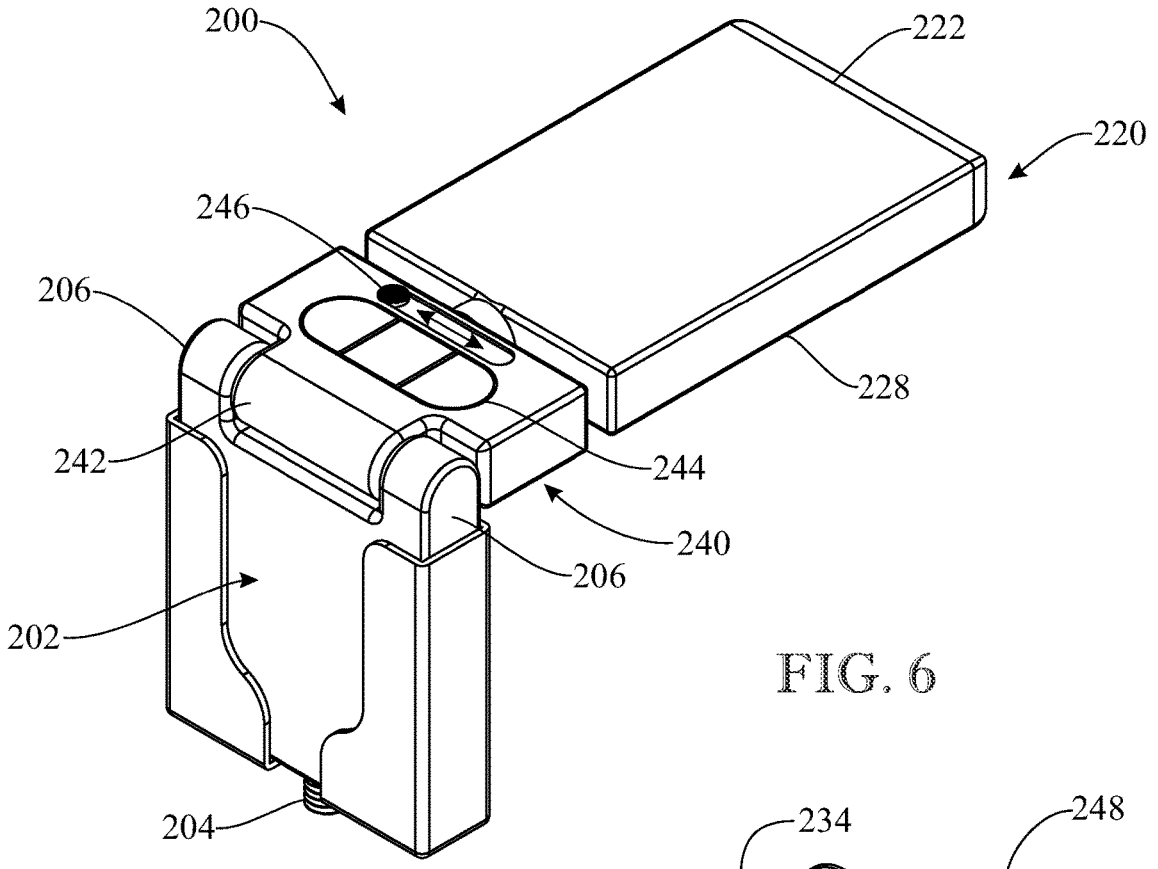
FIG. 6 is a top perspective view of another illustrative embodiment of a razor cleaning device disposed in a first operative configuration, in accordance with the present invention.
Figure 7:
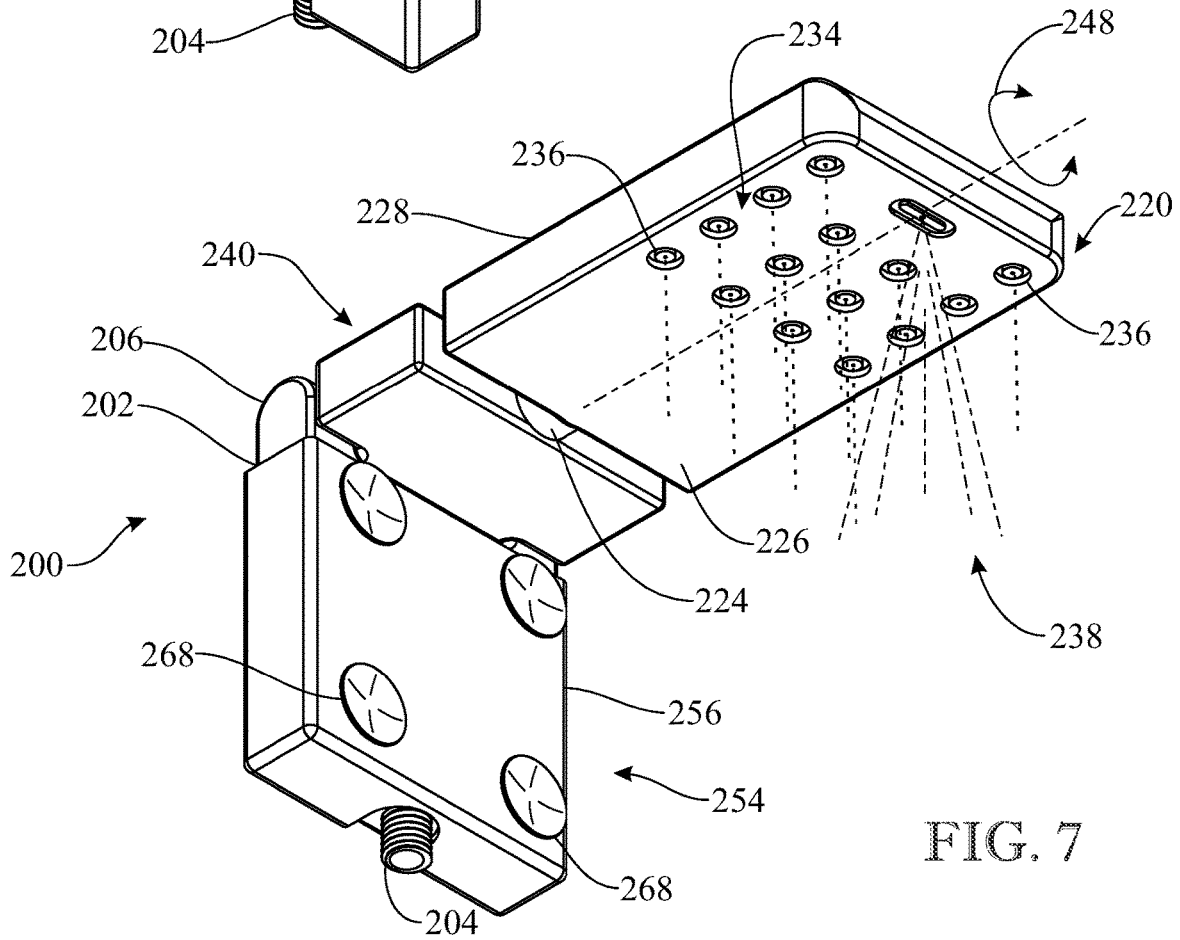
FIG. 7 is a bottom perspective view of the razor cleaning device of FIG. 6, showing a spray head assembly discharging jets of water in a predetermined cleaning pattern to remove hair cutting debris from between one or more blades in a head of a razor positioned thereunder, in accordance with the present invention.

However, and as may be seen from FIGS. 6 and 7, a pivot assembly 240 is provided which interconnects the spray head assembly 220 to the base assembly 202 of the razor cleaning device 200. As shown best in the embodiment of FIG. 6, a pivot assembly 240 includes a pivot member 242 disposed on one end thereof. In at least one embodiment of a razor cleaning device 200 in accordance with the present invention, a base assembly 202 comprises at least one arm member 206 movably interconnected to at least a portion of a pivot member 242. Looking once again to the illustrative embodiment of FIG. 6, the base assembly 202 comprises a plurality of arm members 206 each being movably interconnected to the pivot member 242 along opposite sides thereof.

The spray head assembly 220 in accordance with the present invention includes a spray head 228 having an enclosed surface 222, such as is shown by way of example in FIG. 6, and an oppositely disposed spray surface 226, such as is shown in the illustrative embodiment of FIG. 7. In one embodiment, a spray head assembly 220 comprises at least one spray nozzle 236. With reference to the illustrative embodiment of FIG. 7, the spray head assembly 220 includes a spray nozzle array 234 comprising a plurality of spray nozzles 236. As may be seen from FIG. 7, the plurality of spray nozzles 236 comprising the spray nozzle array 234 are configured and positioned to discharge jets of water in a predetermined spray pattern 238.

As before, the predetermined spray pattern 238 is at least partially defined by the plurality of spray nozzles 236 positioned in the spray nozzle array 234 of the spray head assembly 220. The predetermined spray pattern 238 is further defined by such factors as the dimensions and configuration of the discharge port or ports through each spray nozzle 236, as well as the volume and pressure of the jets of water discharged therethrough.

Also as before, it is understood that the size of each spray nozzle 236 is selected and designed to permit water to jet out at a predetermined force or pressure, and may comprise any number of channels or apertures that are oriented on or along the spray surface 226 of the spray head assembly 220 as needed to produce a predetermined spray pattern 238 therefrom. In one exemplary embodiment, the spray nozzles 236 are disposed in a spray nozzle array 234 forming a generally rectangular orientation along the spray surface 226, as shown, by way of example only, in the illustrative embodiment of FIG. 7. However, as is further understood, in accordance with the present invention, the spray nozzles 236 may be disposed in any variation, layout, or orientation on or along the spray surface 226 of the spray head assembly 220. Each spray nozzle 236 may comprise any of, channels or apertures that are formed through the spray surface 226, or include rubber, plastic, or metal nozzle extensions or ports extending from, or associated with, corresponding spray holes. It will be understood that in another embodiment, the spray head assembly 220 may include a mechanical or electrical system to allow users to adjust both the pattern or delivery pressure of water ejecting from the spray nozzles 236. For example, as before, a rotating disc or valve system can be incorporated to provide a spray pattern, a trickle pattern, a power spray pattern, or any combination thereof.

Figure 10:
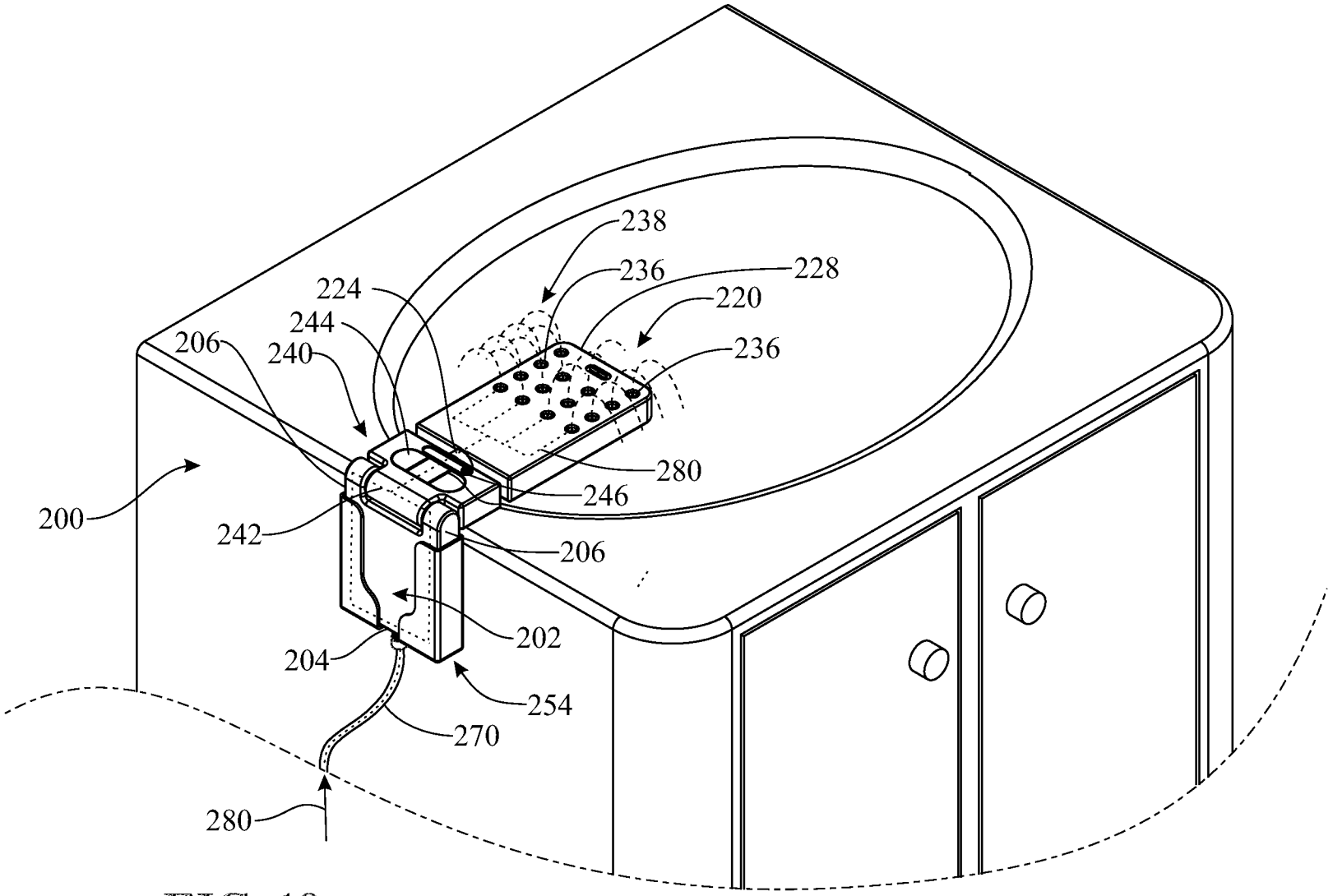
FIG. 10 is a perspective view of the razor cleaning device of FIG. 6, showing the razor cleaning device removably positioned in a base support, and a spray head assembly disposed in an inverted operative configuration over a sink, wherein the spray head assembly is rotated such that a predetermined spray pattern is directed upward and away from the sink, in accordance with at least one embodiment of the present invention.

The spray head assembly 220 of the present razor cleaning device 200 is movable relative to the pivot assembly 240. More in particular, as shown in the illustrative embodiment of FIG. 7, the spray head assembly 220 is rotatably interconnected to the pivot assembly 240 via a spray head interconnect 224 along a central axis therethrough, as shown by directional arrow 248. As such, the spray head 228 may be rotated at least 180° between a first operative configuration, as shown in FIG. 7, and an inverted operative configuration, as shown in FIG. 10, described in further detail below.

Figure 8:
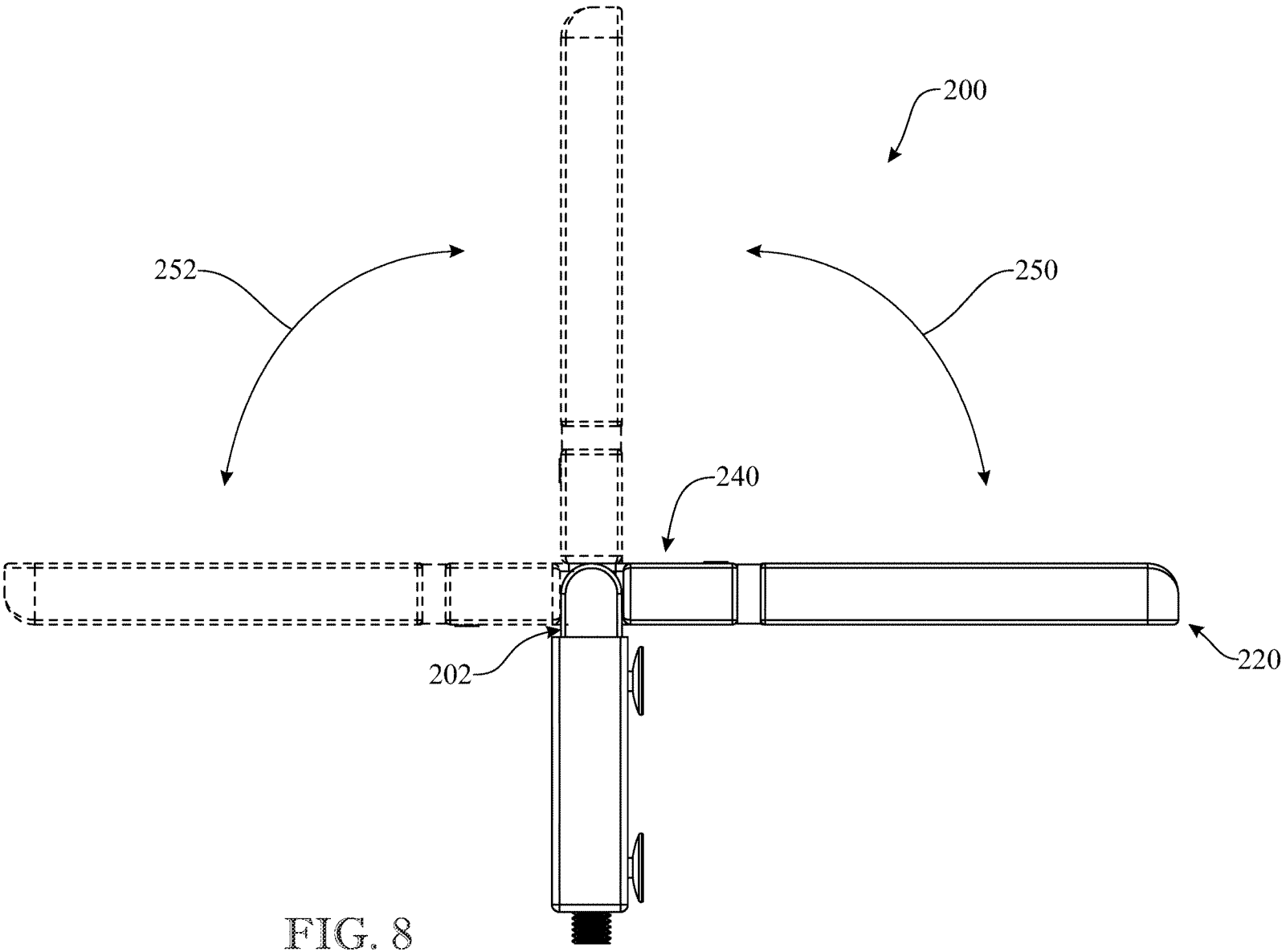
FIG. 8 is a side elevation of the razor cleaning device of FIG. 6, showing a spray head assembly pivotally disposable into and out of an operative configuration relative to a base via a pivot assembly, in accordance with the present invention.

As previously described herein, the razor cleaning device 200 further comprises a pivot assembly 240, wherein the pivot assembly 240 is provided to operatively interconnect the spray head assembly 220 to the base assembly 202. More in particular, and with reference to the illustrative embodiment of FIG. 8, the pivot assembly 240 is operative to allow the spray head assembly 220, interconnected thereto, to be positionable relative to the base assembly 202. Specifically, in at least one embodiment, the pivot assembly 240 allows the spray head assembly 220 to be pivotally rotated from a first operative configuration, at least partially defined by the spray head assembly 220 essentially forming a 90° angle with the base assembly 202, as shown in FIG. 8, to an angle of essentially 180° relative to the base assembly 202, in and along the direction shown by directional arrow 250. In at least one further embodiment, the pivot assembly 240 allows the spray head assembly 220 to be pivotally rotated to an angle of essentially 270° relative the base assembly 202, in and along the further direction shown by directional arrow 252. As will be appreciated, pivot assembly 240 of the present razor cleaning device 200 allows a user to quickly and easily position the spray head assembly 220 into a first operative configuration for use, as well as to rotate it into a storage position while not in use.

Figure 9:
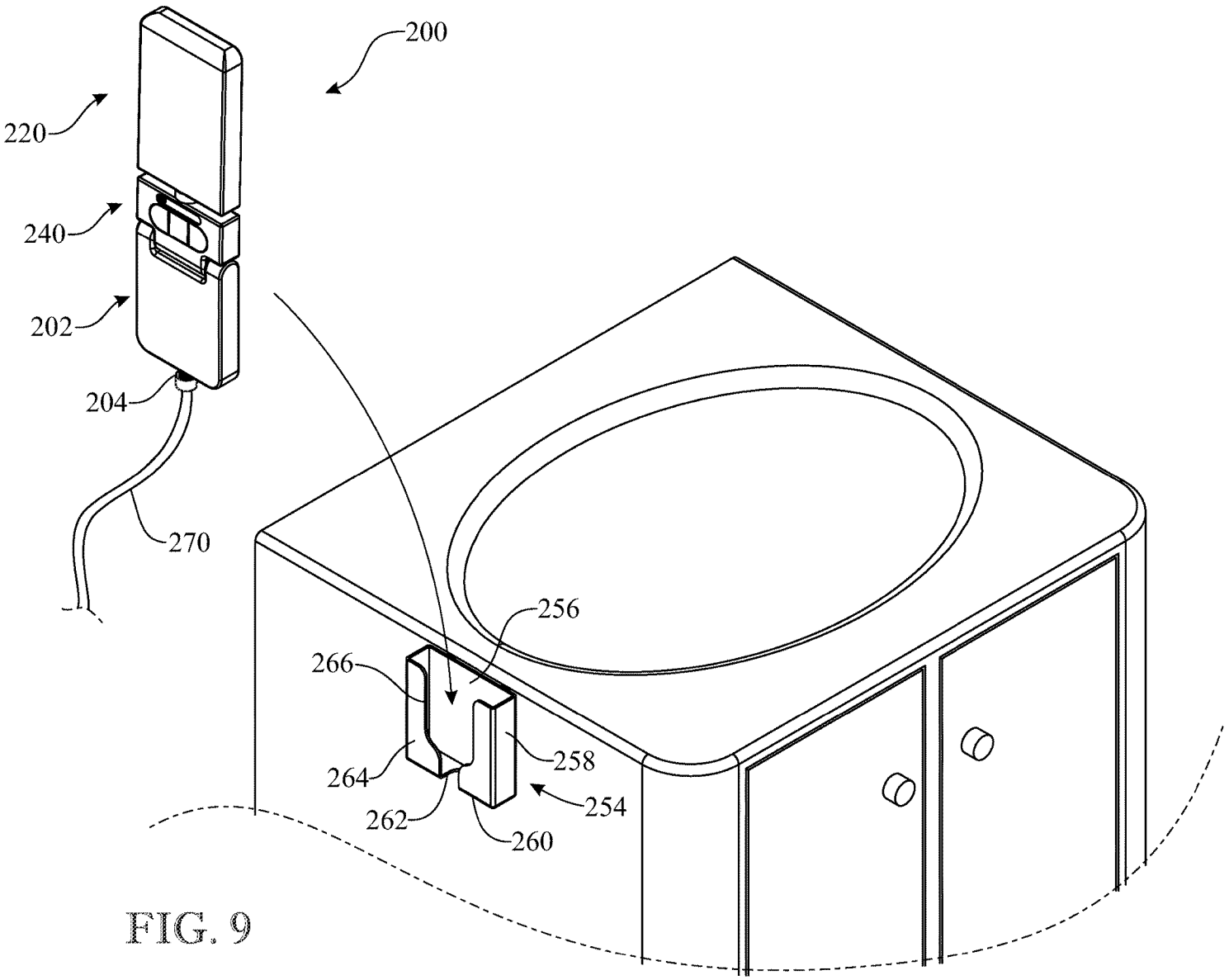
FIG. 9 is a perspective view of the razor cleaning device of FIG. 6, showing the razor cleaning device removed from a base support, in accordance with the present invention.

FIG. 9 is illustrative of a razor cleaning device 200 removed from a base support 254. More in particular, the base support 254 includes a back 256 having at least one mounting member 268 provided to mount the base support 254 of the present razor cleaning device 200 to a portion of a sink, bathtub, and shower, depending upon the location in which a user is shaving. As shown in FIG. 7, in at least one embodiment, a base support 254 includes a plurality of mounting members 268 on a back 256 to mount the base support 254 of the razor cleaning device 200 in, on, and/or around a sink, a bathtub, and/or a shower. As further shown in FIG. 7, each of the plurality of mounting member 268 comprises a suction cup such as are commonly utilized to secure toiletry related items in, on, and/or around a sink, a bathtub, and/or a shower. As will be appreciated, while shown throughout the FIGS. as a suction cup, a mounting member 268 in accordance with the present invention may comprise any of a number of mechanical fasteners to removably or permanently mount a base support 254 in, on, and/or around a sink, a bathtub, or shower, including but not limited to nails, screws, hangers.

With continued reference to the illustrative embodiment of FIG. 9, the base support 254 further comprises sides 258, a bottom 260, and a front 264. Further, in at least one embodiment, the bottom 260 of the base support 254 comprises a bottom notch 262 which is dimensioned to receive at least a portion of a the water inlet 204 and/or a water supply line 270 therein, while a razor cleaning device 200 is disposed in the base support 254. As shown in FIG. 9, the front 264 of the base support 254 further comprises a front cutaway 266, at least a portion of which is communicative and continuous with the bottom notch 262. As such, the razor cleaning device 200 of the present invention, and more in particular, at least the base assembly 202 including the water inlet 204 and/or the water supply line 270 of the present razor cleaning device 200 is removably positionable into and out an operative supported disposition within the base support 254. In at least one embodiment, both the base assembly 202 and the water inlet 204 and/or the water supply line 270 of the present razor cleaning device 200 are removably positionable into and out an operative supported disposition within the base support 254.

Turning, finally, to the illustrative embodiment of FIG. 10, a razor cleaning device 200 in accordance with the present invention is shown removably positioned in a base support 254 which is mounted adjacent a sink. A spray head assembly 220 is disposed in an inverted operative configuration over a sink, wherein a spray head 228 is rotated such that a predetermined spray pattern 238 is directed upward and away from the sink, in accordance with at least one embodiment of the present invention.

With further reference to FIG. 10, dashed line 280 is illustrative of a water flow path into and through a razor cleaning devoice 200 in accordance with at least one embodiment of the present invention. To begin, water is provided to the razor cleaning device 200 via the water supply line 270, which is interconnected to the water inlet 204 of the base assembly 202. The base assembly 202, in at least one embodiment, includes a plurality of water delivery conduits which allow water to flow through the base assembly 202, along water flow path 280, and into each arm member 206 thereof, and then into opposite ends of the pivot member 242 of pivot assembly 240. As before, a valve control switch 244 is operable with a valve (not shown), such that a user may open the valve and permit water to flow into and through the spray head assembly 220, as desired. Water then flows through the pivot assembly 240 and into the spray head assembly 220 through spray head interconnect 224. Finally, water delivery conduits in the spray head assembly 220 direct water flow, once again, along water flow path 280, into and through each of a plurality of spray nozzles 236 in a predetermined spray pattern 238.

Once again, as shown in FIG. 10, the spray head assembly 220 is disposed in an inverted operative configuration over a sink, wherein the spray head 222 is rotated such that a predetermined spray pattern 238 is directed upward and away from the sink, thereby providing a gentle upward flow of water out of the spray head assembly 220 to allow a user to conduct less rigorous cleaning operations at a reduced water flow and pressure.

As such, to facilitate use of the present razor cleaning device 200 in the inverted operative configuration of FIG. 10, the razor cleaning device 200 includes a flow regulator (not shown) structured to limit the volume and pressure of water flow provided to the spray head assembly 220. A regulator control switch 246 is positionable by a user to select full flow, for example as indicated by the position of the regulator control switch 246 in the illustrative embodiment of FIG. 6, or to select minimum flow, as indicated by the position of the regulator control switch 246 in the illustrative embodiment of FIG. 10. As will be appreciated, a flow regulator may be designed to provide either a maximum or a minimum flow regime, or it may be designed to provide a plurality of distinct flow regimes which a user may select from between a maximum and a minimum flow regime. Alternatively, a flow regulator may be designed to provide a continuous range of flow regimes which a user may select from between a maximum and minimum flow regime.

A razor cleaning device 100, 200 in accordance with the present invention can be engineered and designed to accommodate specific brands of men's and women's razors having razor blade heads or razor blade cartridges comprising different sizes and/or shapes. Further, the razor cleaning device 100, 200 may include aesthetic indicia, patterns, or designs, come in a range of different colors, styles, or popular finishes such as chrome, bronze, brushed chrome, white, ivory, or other colors. A detachable razor holder may be incorporated for holding one or more razors, and various hygiene accessories may be included with, or sold separately from, the razor cleaning device 100, 200 in accordance with the present invention.

Since many modifications, variations, and changes in detail can be made to the described preferred embodiments of the invention, it is intended that all matters in the foregoing description and shown in the accompanying drawings be interpreted as illustrative and not in a limiting sense. Furthermore, it is understood that any of the features presented in the embodiments may be integrated into any of the other embodiments unless explicitly stated otherwise. The scope of the invention should be determined by the appended claims and their legal equivalents.

What is claimed is:

1. A razor cleaning device for use in a sink, bathtub or shower disposed in fluid communication with a water supply line to allow a user to quickly and efficiently dislodge and displace hair cutting debris which accumulates between one or more blades in a head of a razor while shaving, said razor cleaning device comprising:

a base assembly having a water inlet disposed in fluid communication with the water supply line to permit a flow of water into and through said base assembly;

a spray head assembly operatively interconnected to said base assembly having an enclosed surface on one side and a spray surface on an oppositely disposed other side;

said spray surface having at least one spray nozzle disposed thereon;

said water inlet disposed in fluid communication with said at least one spray nozzle;

said spray head assembly further comprising a valve control switch operatively disposed in communication between said water inlet and said at least one spray nozzle, said valve control switch operable by the user into and out of an open position, wherein said open position permits water to flow through said water inlet to said at least one spray nozzle; and said at least one spray nozzle disposed to discharge jets of water in a predetermined spray pattern while said valve control switch is disposed in said open position, wherein the jets of water discharged through said at least one spray nozzle in said predetermined spray pattern are sufficient to dislodge hair cutting debris which accumulates between one or more blades in the head of the razor, and to discharge the hair cutting debris therefrom.

2. The razor cleaning device as recited in claim 1, wherein said spray head assembly is positionable into and out of an operative configuration.

3. The razor cleaning device as recited in claim 1, wherein said spray surface includes a plurality of spray nozzles disposed in a spray nozzle array thereon.

4. The razor cleaning device as recited in claim 1, wherein said spray head assembly comprises a plurality of spray nozzles disposed in a spray nozzle array and said water inlet is disposed in fluid communication with said plurality of spray nozzles.

5. The razor cleaning device as recited in claim 1, wherein said spray head assembly comprises a plurality of spray nozzles disposed in a spray nozzle array on said spray surface thereof.

6. The razor cleaning device as recited in claim 1, wherein said spray head assembly comprises a plurality of spray nozzles disposed in a spray nozzle array to discharge jets of water in said predetermined spray pattern.

7. The razor cleaning device as recited in claim 1, wherein spray head assembly is movable relative to said base assembly.

8. The razor cleaning device as recited in claim 1, wherein said spray head assembly is disposed in a sliding engagement with said base assembly.

9. The razor cleaning device as recited in claim 1, wherein said spray head assembly is disposed in a rotational engagement with said base assembly.

10. The razor cleaning device as recited in claim 1, wherein said spray head assembly is disposed in a pivotal engagement with said base assembly.

11. The razor cleaning device as recited in claim 1, further comprising a pivot assembly disposed in an interconnecting disposition between said base assembly and said spray head assembly.

12. The razor cleaning device as recited in claim 1, further comprising a flow regulator to provide a range of flow regimes selectable by the user.

13. The razor cleaning device as recited in claim 1, further comprising at least one mounting member to facilitate maintaining said spray head assembly in said operative configuration.

14. The razor cleaning device as recited in claim 1, further comprising a plurality of mounting members to facilitate maintaining said spray head assembly in said operative configuration.

15. A razor cleaning device for use in a sink, bathtub or shower disposed in fluid communication with a water supply line to allow a user to quickly and efficiently dislodge and displace hair cutting debris which accumulates between one or more blades in a head of a razor while shaving, said razor cleaning device comprising:

a base assembly having a water inlet disposed in fluid communication with the water supply line to permit a flow of water into and through said base assembly;

a spray head assembly operatively interconnected to said base assembly having an enclosed surface on one side and a spray surface on an oppositely disposed other side;

said spray surface having a plurality of spray nozzles disposed in a spray nozzle array thereon;

said water inlet disposed in fluid communication with said plurality of spray nozzles;

said spray head assembly further comprising a valve control switch operatively disposed in communication between said water inlet and said plurality of spray nozzles, said valve control switch operable by the user into and out of an open position, wherein said open position permits water to flow through said water inlet to said plurality of spray nozzles; and said plurality of spray nozzles cooperatively disposed in said spray nozzle array to discharge jets of water in a predetermined spray pattern while said valve control switch is disposed in said open position, wherein the jets of water discharged through said plurality of spray nozzles in said predetermined spray pattern are sufficient to dislodge hair cutting debris which accumulates between one or more blades in the head of the razor, and to discharge the hair cutting debris therefrom.

16. The razor cleaning device as recited in claim 15, wherein said spray nozzle array is at least partially defined by said plurality of spray nozzles disposed around a periphery of said spray surface.

17. The razor cleaning device as recited in claim 15, wherein said spray nozzle array is at least partially defined by said plurality of spray nozzles disposed in a rectangular orientation on said spray surface.

18. The razor cleaning device as recited in claim 15, wherein spray head assembly is movable relative to said base assembly.

19. The razor cleaning device as recited in claim 15, wherein said spray head assembly is positionable into and out of an operative configuration.

20. A razor cleaning device for use in a sink, bathtub or shower disposed in fluid communication with a water supply line to allow a user to quickly and efficiently dislodge and displace hair cutting debris which accumulates between one or more blades in a head of a razor while shaving, said razor cleaning device comprising:

a base assembly having a water inlet disposed in fluid communication with the water supply line to permit a flow of water into and through said base assembly;

a spray head assembly operatively interconnected to and disposed in fluid communication with said base assembly having an enclosed surface on one side and a spray surface on an oppositely disposed other side, said spray head assembly is positionable into and out of an operative configuration;

a plurality of mounting members to facilitate maintaining said spray assembly in said operative configuration;

said spray surface having a plurality of spray nozzles disposed in a spray nozzle array thereon;

said water inlet disposed in fluid communication with said plurality of spray nozzles;

said spray head assembly further comprising a valve control switch operatively disposed in communication between said water inlet and said plurality of spray nozzles, said valve control switch operable by the user into and out of an open position, wherein said open position permits water to flow through said water inlet to said plurality of spray nozzles; and said plurality of spray nozzles cooperatively disposed in said spray nozzle array to discharge jets of water in a predetermined spray pattern while said valve control switch is disposed in said open position, wherein the jets of water discharged through said plurality of spray nozzles in said predetermined spray pattern are sufficient to dislodge hair cutting debris which accumulates between one or more blades in the head of the razor, and to discharge the hair cutting debris therefrom.

* * * * *